United States Patent [19]

McInnis et al.

[11] 4,092,921

[45] June 6, 1978

[54] HIGH SPEED PRINTER MODULE

[75] Inventors: Andrew M. McInnis, Covina; Robert A. Nielsen, Pasadena, both of Calif.

[73] Assignee: Sheldon-Sodeco Printer, Inc., Elmsford, N.Y.

[21] Appl. No.: 690,579

[22] Filed: May 27, 1976

[51] Int. Cl.² ..... B41J 1/32

[52] U.S. Cl. ..... 101/93.21; 400/617; 101/93.04; 400/635; 400/196.1

[58] Field of Search ..... 101/93.04, 93.05, 93.09, 101/93.18, 93.19, 93.21, 93.22, 93.23, 110, 336, 168, 175, 93.27–93.34; 197/1 R, 133 R, 138, 168

[56] References Cited

U.S. PATENT DOCUMENTS

| | | | |
|---|---|---|---|
| 3,048,253 | 8/1962 | Oldenburg et al. | 197/133 R |
| 3,283,702 | 11/1966 | Higgins et al. | 101/93.04 |
| 3,598,045 | 8/1971 | Miller | 101/93.28 |
| 3,724,366 | 4/1973 | Murthy et al. | 101/93.31 |
| 3,804,008 | 4/1974 | Hoyer | 101/93.04 |
| 3,871,507 | 3/1975 | Perry et al. | 197/151 |
| 3,880,271 | 4/1975 | Hebron | 197/157 |
| 3,919,936 | 11/1975 | Barrus et al. | 101/93.29 X |
| 3,949,664 | 4/1976 | Shimodaira et al. | 101/93.31 |

*Primary Examiner*—Edward M. Coven

*Attorney, Agent, or Firm*—Kane, Dalsimer, Kane, Sullivan and Kurucz

[57] ABSTRACT

An impact printer employing a continuously rotating print drum is constructed to accept different sizes and thicknesses of print sheets between the drum and hammers; one of such sheets for example comprises an endwise feedable sheet automatically advanced, by index means, beneath the drum and upwardly into a slot between the drum and hammers. Unusually advantageous sheet clamping means and type fonts on the drum, are also provided, to increase printing speed.

6 Claims, 26 Drawing Figures 11
13
14
14a
16
19
23
23b
26
27
41
42
59
63
63a
64
65
66
88
90
90a
91
92
121
122
140
140'
141
142
143
4
5
6

10
10

11
11
12
13
14
14a
15a
16
17
19
20
21
22
23
23a
23b
24
25
26a
27
31
31a
33
34
35
36
36a
37
37a
38
38a
39
41
42
43
44
45
45a
45b
45c
45d
46
47b
48
51
52
59
100
140
141
142
150

| SEG. / CHAR. | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 30 | 31 | 32 | 33 |
|---|---|---|---|---|---|---|---|---|---|---|---|---|---|---|---|---|---|---|---|---|---|---|---|---|---|---|---|---|---|---|---|---|---|---|
| A | | | | | | | | | | | | | | | X | | | | | | X | | | | | | X | | | | | | | |
| B | | | X | | | X | | | X | | | | | | | | | | | | | X | | | | | X | | | | | | | |
| C | | | X | | | | | | | | | | | | | | | | | | | X | | | | | X | | | | | | | |
| D | | | | | X | | | | | X | | | | | | | | | | | | | | | | | X | | | | | | | |
| E | | | X | | | | | | | | | | | | | | | | | | X | | | | | | X | | | | | | | |
| F | | | | | | | | | | | | | | | | | | | | | X | | | | | | X | | | | | | | |
| G | | | | | X | | | | | | | | X | | | | | | | | | X | | | | | X | | | | | | | |
| H | | | | X | | | | | | | | | | | X | | | | | | | | | | | | X | | | | | | | |
| I | | | X | | | | | | | | | | | | | | | | | | | X | | | X | | | | | | | | | |
| J | | | X | | | | | | | | | | | | X | | | | | | | | | | | | | | | | X | | | |
| K | | | | | | X | | | X | | | | | | | | | | | | | | | | | | X | | | | | | | |
| L | | | X | | | | | | | | | | | | | | | | | | | | | | | | X | | | | | | | |

Fig. 23.

| | 0 | 1 | 2 | 3 | 4 | 5 | 6 | 7 | 8 | 9 | 10 | 11 | 12 | 13 | 14 | 15 | 16 | 17 | 18 | 19 | 20 | 21 | 22 | 23 | 24 | 25 |
|---|---|---|---|---|---|---|---|---|---|---|---|---|---|---|---|---|---|---|---|---|---|---|---|---|---|---|
| (SPACE) | | | | | | | | | | | | | | | | | | | | | | | | | | |
| ! | | | | | | | | | | X | X | | | | | | | | | | | | | | | |
| " | | | | | | | | | | X | | | | X | | | | | | | | | | | | |
| # | | | X | | | | | | | | | | | | | | | | | | | | | | | |
| $ | | | | | | | X | X | X | X | | | | X | | | X | | | | | | | | X | |
| % | X | | | | | | | | | | X | | | | | | | | | | | | X | | | |
| & | | | | | | | X | | X | X | | | X | | | X | | | | | | X | | | | |
| ' | | | | | | | | | | X | | | | | | | | | | | | | | | | |
| * | | | | | X | | | X | | | | | | | | | | | | | | | X | | | |
| + | | | | | | | | X | X | X | | | | | | | | | | | | | | | | |
| , | | | | | | | | | X | | | X | | | | | | | | | | | | | | |
| - | | | | | | | | X | | | | | | | | | | | | | | | | | | |
| . | | | | | | | | | | | X | | | | | | | | | | | | | | | |
| / | | | | | | | | | | | | | | | | | | | | | | | X | | | |
| | | | | | | | | | | | | | | | | | | | | | | | | | | |
| 0 | | | | | | | X | | | | | | X | X | | | X | X | | | | | X | | X | |
| 1 | | | | | | | | | X | X | | | | | | | | | | | | | | | | |
| 2 | | | | | | | X | X | | | | | X | | | | | X | | | | | | | | |
| 3 | | | | | | | X | X | | | | | | | | | X | X | | | | | | | | |
| 4 | | | | | | | | X | | | | | | X | | | X | X | | | | | | | | |
| 5 | | | | | | | | X | | | | | | X | X | | | | | | | | | | X | |
| 6 | | | | | | | X | X | | | | | X | X | | | X | | | | | | | | X | |
| 7 | | | | | | | | | | | | | | | | | X | X | | | | | | | X | |
| 8 | | | | | | | X | X | | | | | X | X | | | X | X | | | | | | | X | |
| 9 | | | | | | | X | X | | | | | | X | | | X | X | | | | | | | X | |
| : | | | | | | | | | | | X | X | | | | | | | | | | | | | | |
| = | | | | | | | X | X | | | | | | | | | | | | | | | | | | |
| ? | | | | | | | | | X | | X | | | | | | | | X | | X | | | | | |
| | | | | | | | | | | | | | | | | | | | | | | | | | | |
| A | | | | | | | | X | | | | | X | X | | | X | X | | | | | | | X | |
| B | | | | | | | X | | | | | | X | X | | X | | | X | | | | | | X | |
| C | | | | | | | X | | | | | | X | X | | | | | | | | | | | X | |
| D | | | | | | | | | | | | | X | X | X | | | | | X | | | | | | |
| E | | | | | | | X | X | | | | | X | X | | | | | | | | | | | X | |
| F | | | | | | | | X | | | | | X | X | | | | | | | | | | | X | |
| G | | | | | | | X | | | | | | X | X | | | X | | | | X | | | | X | |
| H | | | | | | | | X | | | | | X | X | | | X | X | | | | | | | | |
| I | | | | | | | X | | X | X | | | | | | | | | | | | | | | X | |
| J | | | | | | | X | | | | | | X | | | | X | X | | | | | | | | |
| K | | | | | | | | | | | | | X | X | | X | | | X | | | | | | | |
| L | | | | | | | X | | | | | | X | X | | | | | | | | | | | | |
| M | | | | | | | | | X | | | | X | X | | | X | X | | | | | | | X | |
| N | | | | X | | | | | | | | | X | X | | | X | X | | | | | | | | |
| O | | | | | | | X | | | | | | X | X | | | X | X | | | | | | | X | |
| P | | | | | | | | X | | | | | X | X | | | | X | | | | | | | X | |
| Q | | | | X | | | | | | | | | X | X | X | | | X | | | | | | | X | |
| R | | | | | | | | | | | | | X | X | | X | | | X | | | | | | X | |
| S | | | | | | | X | X | | | | | | X | | | X | | | | | | | | X | |
| T | | | | | | | | | X | X | | | | | | | | | | | | | | | X | |
| U | | | | | | | X | | | | | | X | X | | | X | X | | | | | | | | |
| V | | | | | | | | | | | | | X | X | | | | | | | | | | | | |
| W | | | | | | | X | | X | | | | X | X | | | X | X | | | | | | | | |
| X | | | | X | | | | | | | | | | | | | | | | | | | | | | |
| Y | | | | | | | | X | X | | | | | X | | | | X | | | | | | | | |
| Z | | | | | | | X | | | | | | | | | | | | | | | | | | | |
| | | | | | | | | | | | | | | | | | | | | | | | | | | |
| \ | | | | X | | | | | | | | | | | | | | | | | | | | | | |
| ÷ | X | | | | | | | X | | | X | | | | | | | | | | | | | | | |

HIGH SPEED PRINTER MODULE

BACKGROUND OF THE INVENTION

This invention relates generally to high speed, on-the-fly line printers, one example of which is described in U.S. Pat. No. 3,850,097. This invention includes subject matter that constitutes an improvement on the invention disclosed in that certain U.S. patent application Ser. No. 572,067 filed Apr. 28, 1975 by John A. Pylant et al.

There is a continuing need for electromechanical line printers characterized by high-speed, malfunction-free operation as well as simplicity, ruggedness and low cost, and highly compact design. No prior printers of which we are aware meet all these needs and with the unusual advantage as are now afforded by the present invention. Also, no such prior printers were capable of accepting forms or print sheets of a wide variety of sizes.

SUMMARY OF THE INVENTION

It is a major object of the invention to provide an on-the-fly printer overcoming disadvantages of prior devices and meeting the needs as described above. Basically, the printer apparatus is operable to rapidly print characters in lines and columns on a print sheet, and comprises:

a. a first assembly including a rotary print drum, having an axis of rotation, b. a second assembly including hammer means, a print transfer medium carrier therefor, and c. support means supporting said assemblies in spaced relation to provide a print sheet receiving slot between the drum at one side of the slot and the local ribbon extent and hammer means at the opposite side of the slot.

As will appear, the assemblies are generally longitudinally spaced and the slot extends transversely between the assemblies and is transversely open ended; the support means may typically include a base plate extending in under supporting relation to the two assemblies; and the support means may include side plates for each of the assemblies, certain side plates being shiftable laterally to enlarge the space between the side plates of each assembly so that longer length drums, more hammers and longer length print transfer means (such as inked ribbons) may be employed, i.e. the apparatus is modular to accept a wide variety of component sizes as may be required to accommodate to different size print sheets.

Further, print sheet advancing means may be associated with the first assembly to advance an endwise feedable print sheet beneath the drum and then upwardly in the slot, such advancing means comprising a pair of rotors and associated ratchet means and drive to rotatably index the rotors; the rotors may include certain peripheral friction rings to engage and advance the endwise feedable sheet and other peripheral friction loops to frictionally engage and advance a print sheet placed in the slot. Associated pinch rollers are provided to assist in clamping the endwise feedable sheet and the print sheet against the rings and loops, for advancement.

Additional objects include the provision of hammers and clamp means to momentarily clamp the sheet being subjected to printing by operation of the hammers in conjunction with type font sections on the on-the-fly drum and with an inked ribbon; the provision of an ink ribbon carrier to supply an endless ribbon, mechanism to advance the ribbon between the hammers and print sheet, and means to tilt the ribbon carrier; and unique type font segments employed on the rotary drum as will appear.

These and other objects and advantages of the invention, as well as the details of an illustrative embodiment, will be more fully understood from the following description and drawings, in which:

DRAWING DESCRIPTION

Figures 10, 10A:
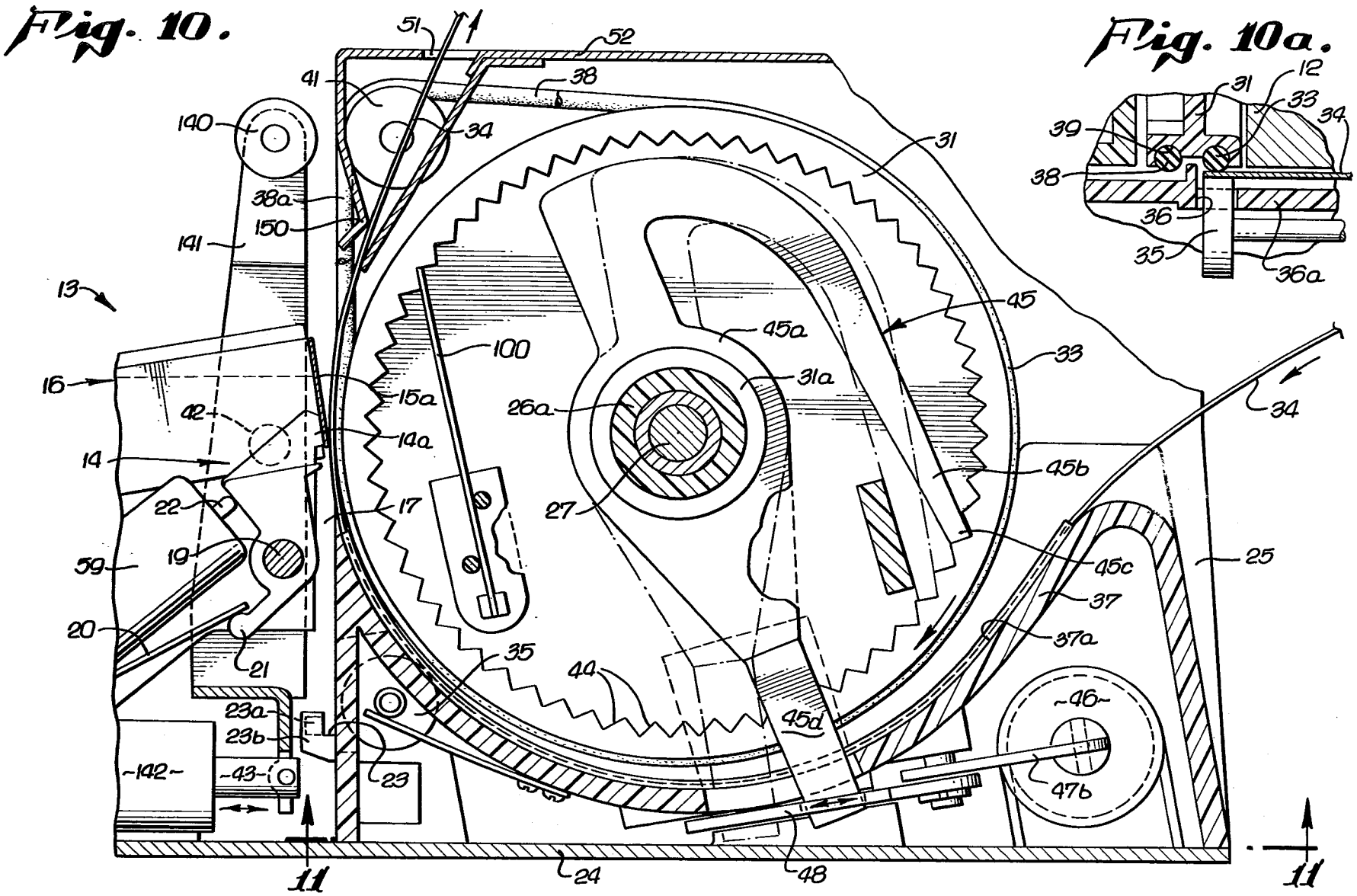
FIG. 10 is an enlarged side elevation, partly in section, taken on lines 10—10 of FIG. 6.
Figure 11:
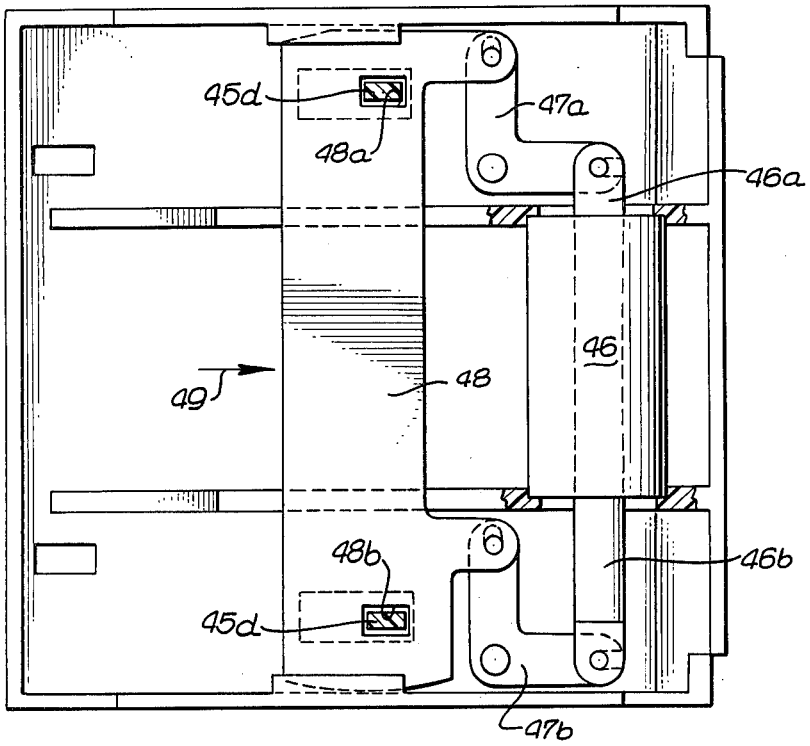
Figure 12:
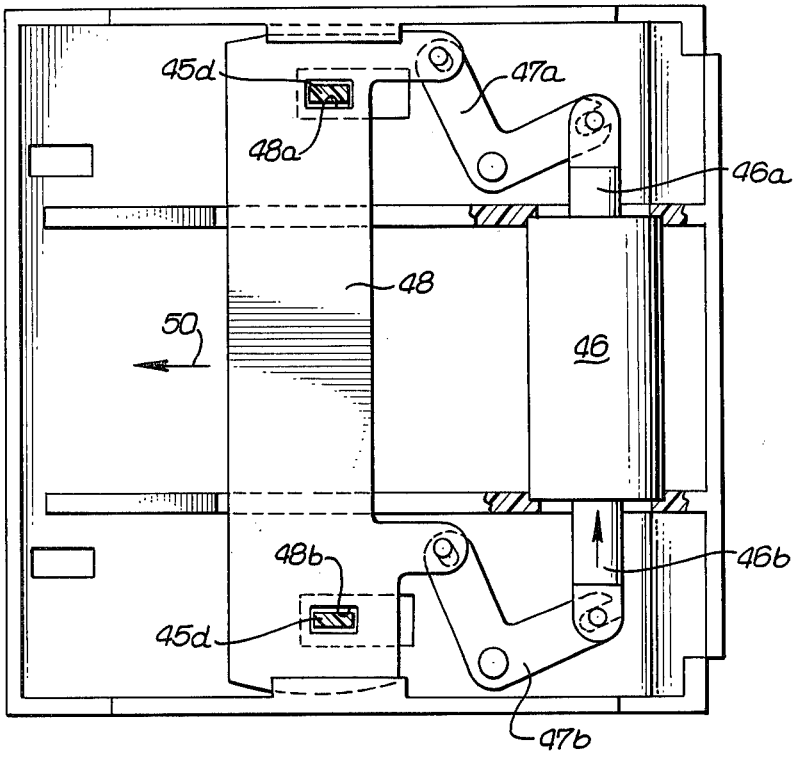
Figure 14:
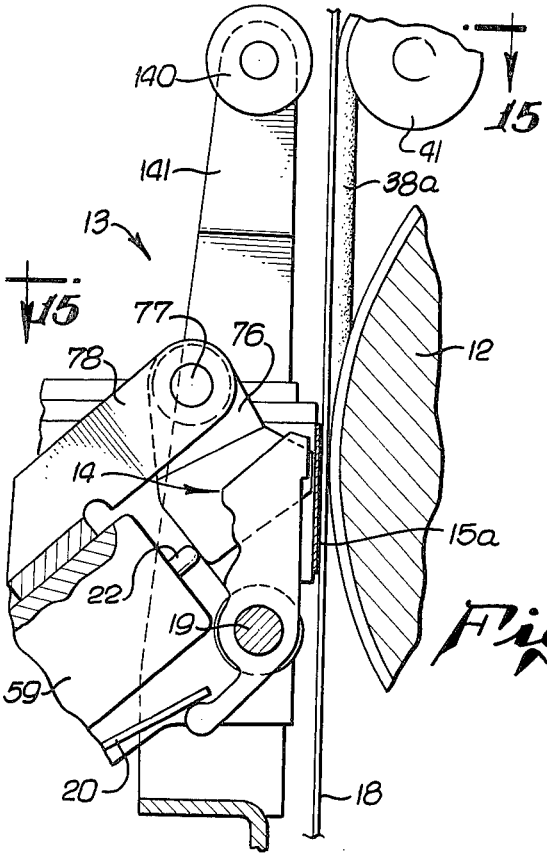
Figure 15:
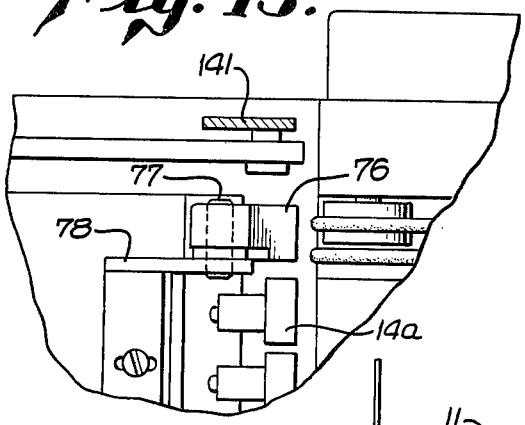
Figure 13:
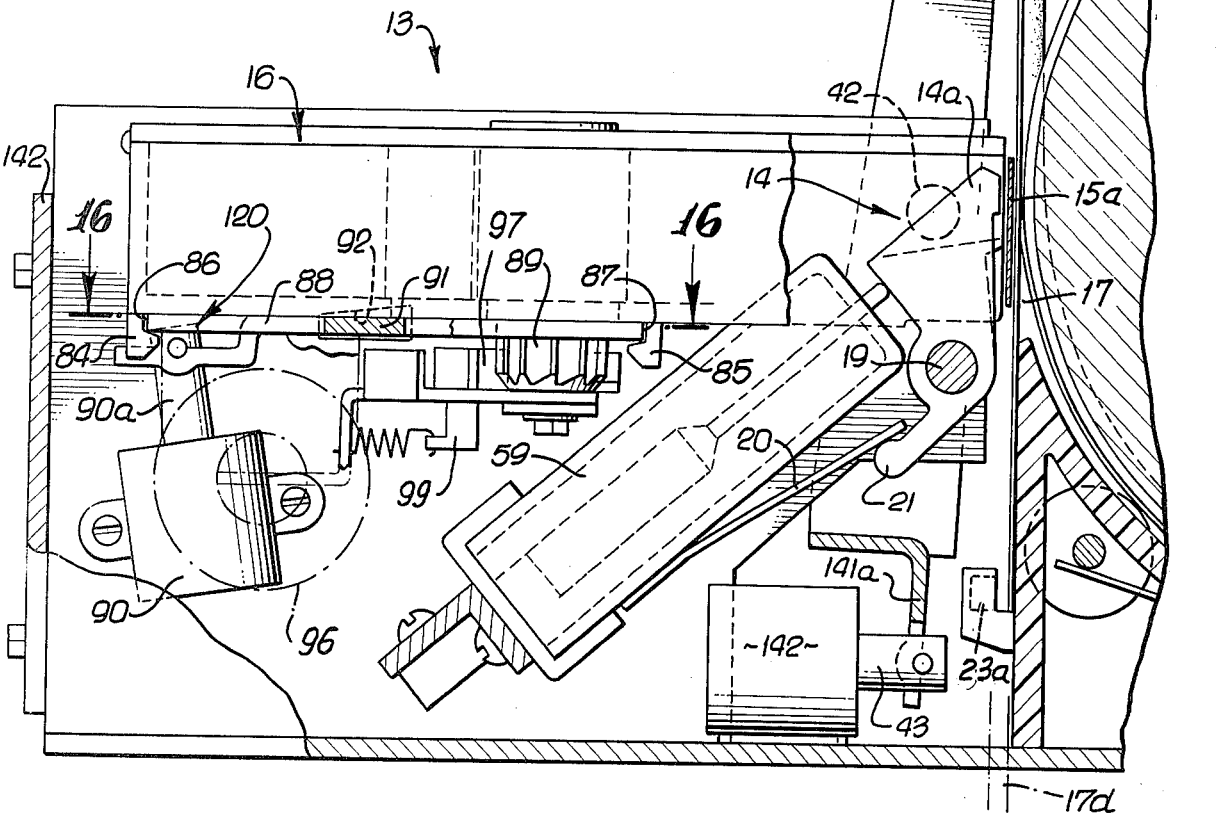
Figure 16:
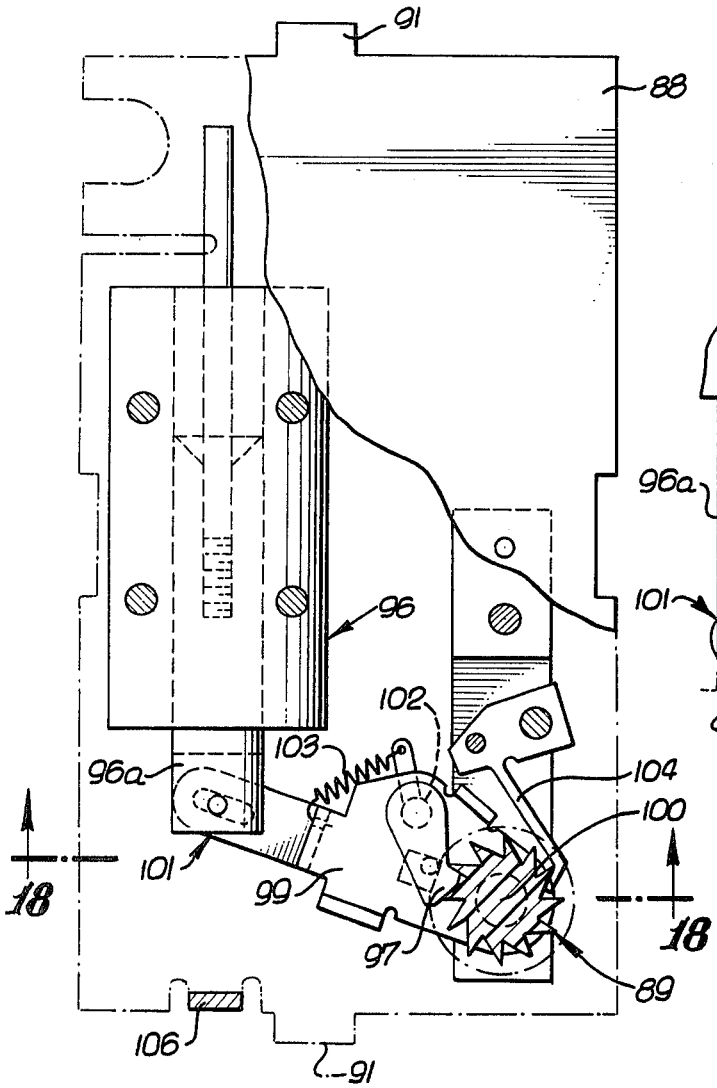
Figure 17:
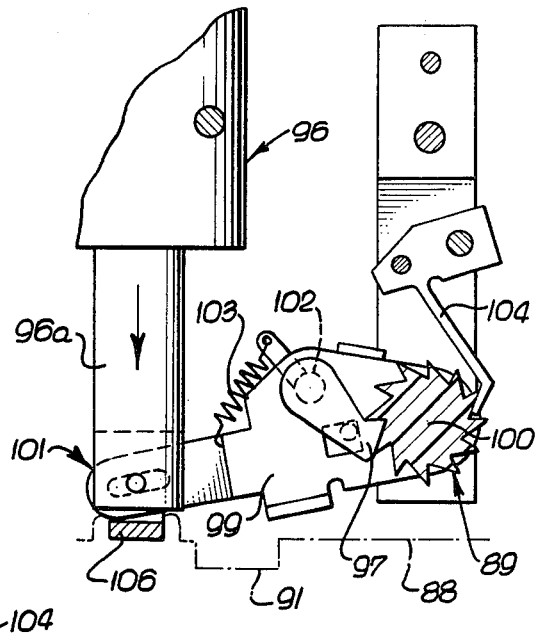
Figure 18:
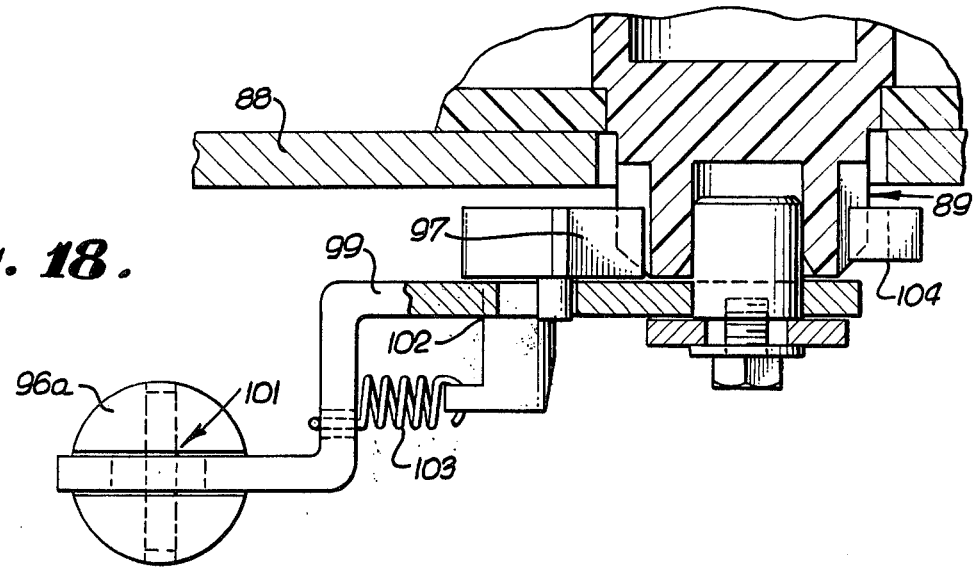
Figure 19:
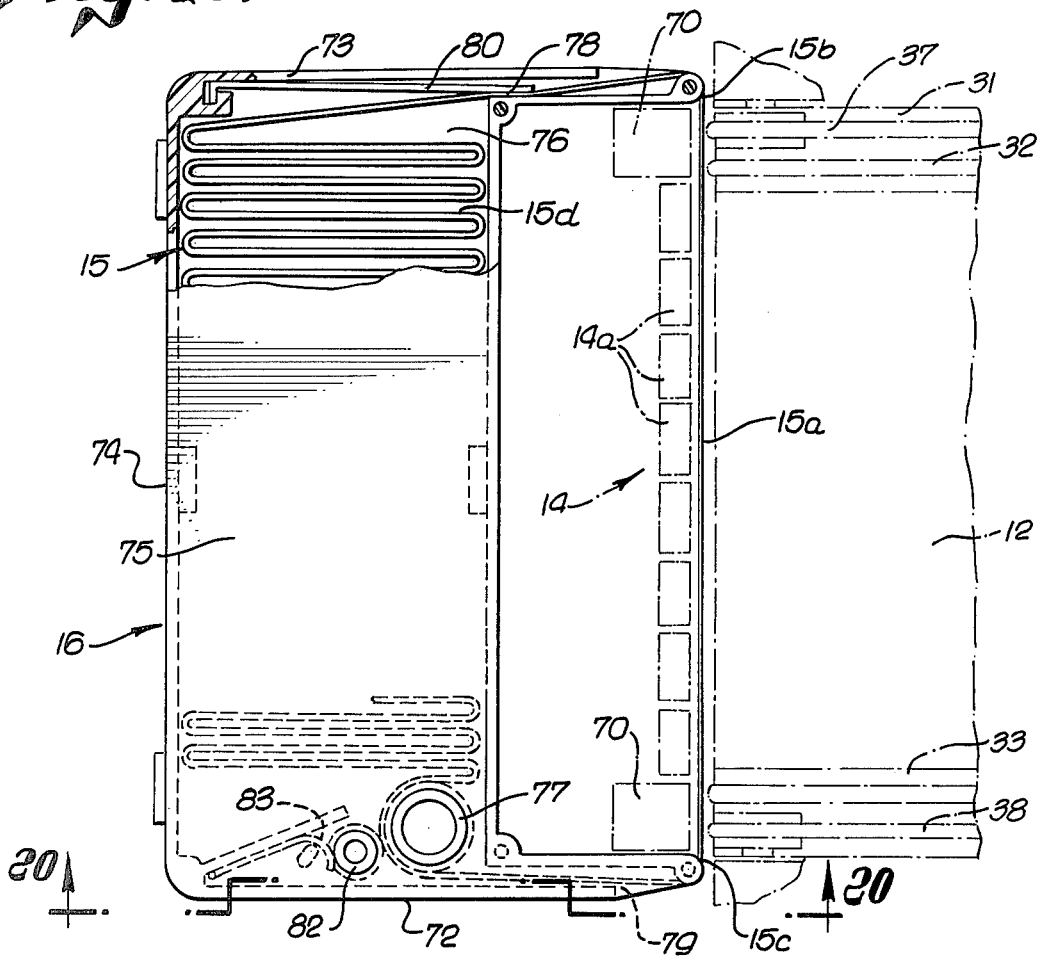
Figure 20:
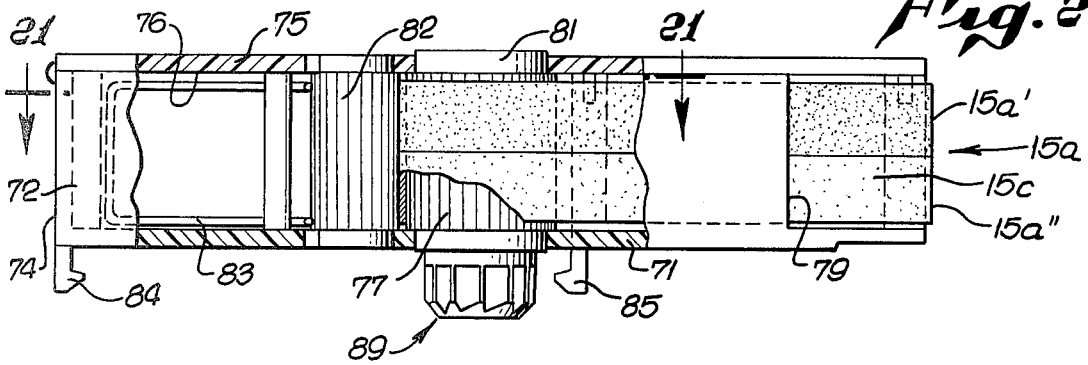
Figure 21:
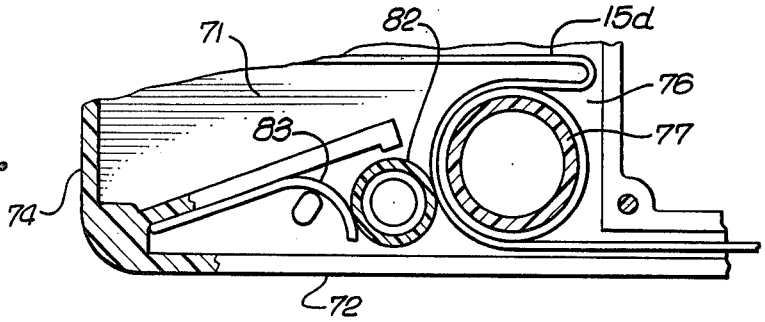
Figures 22, 25:
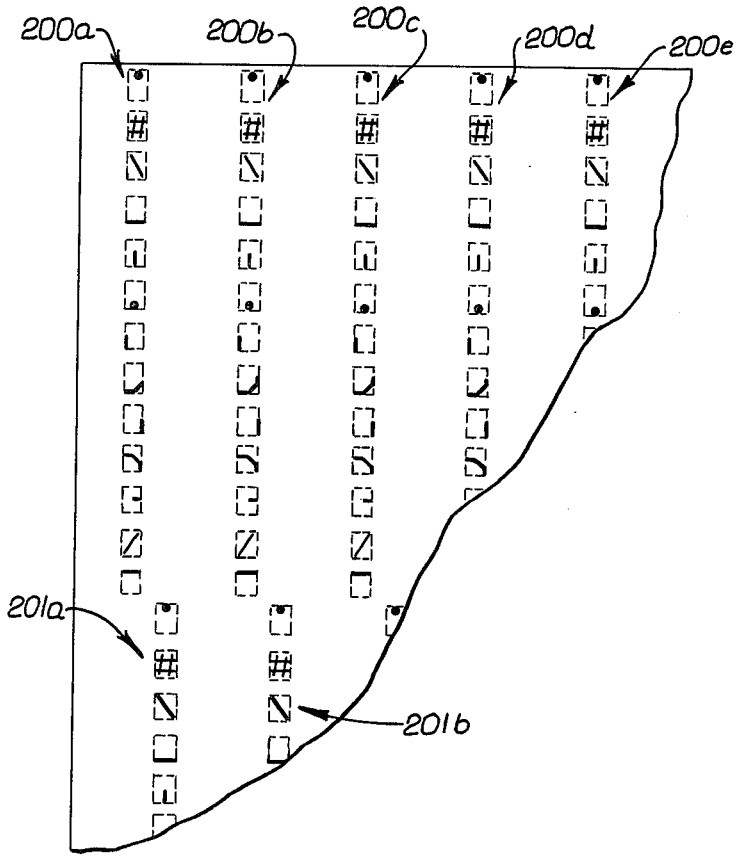
Figure 24:
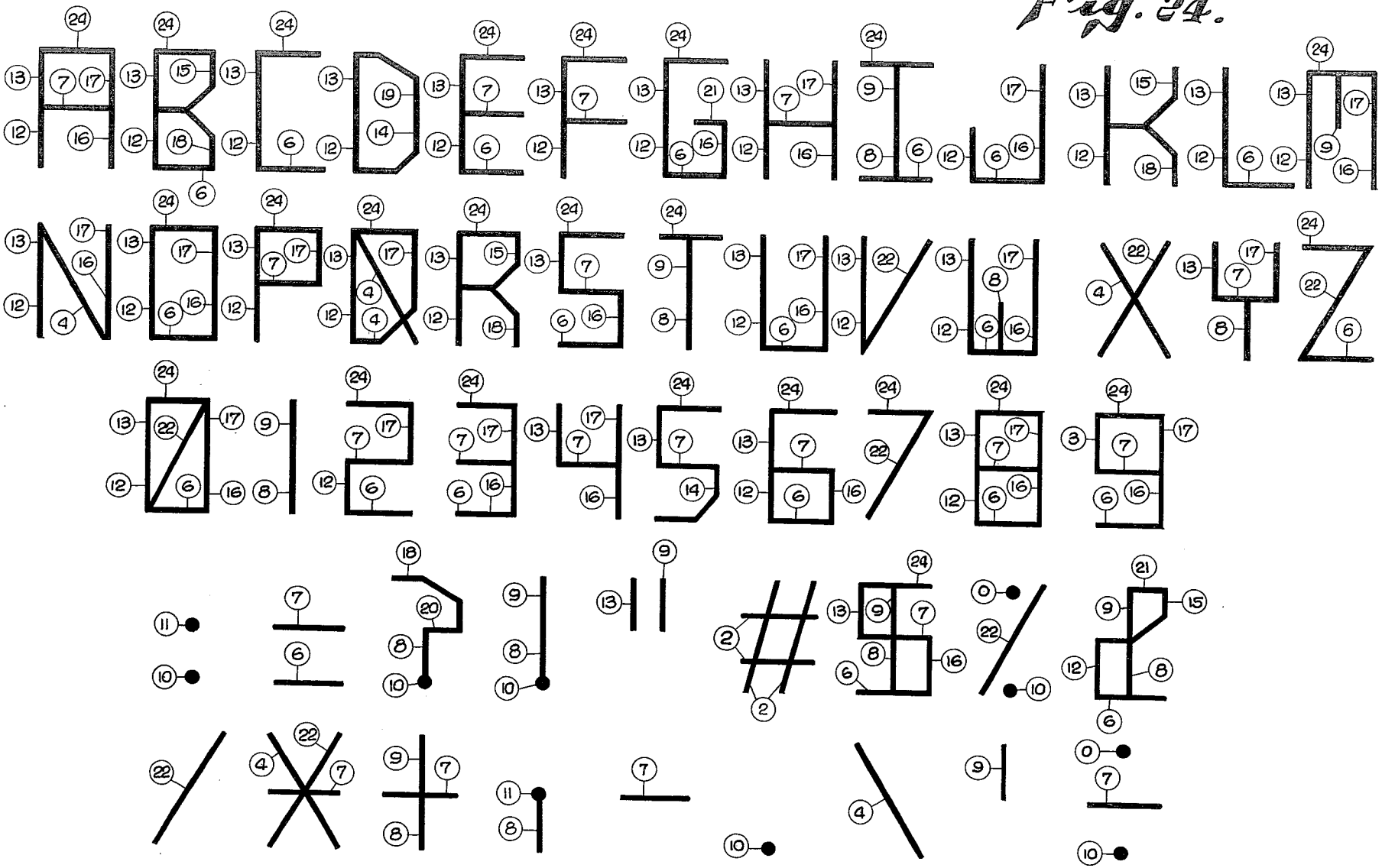

FIG. 10*a* is an enlarged section showing different means for advancing different sheet media;

FIG. 11 is a bottom plan view taken on lines 11—11 of FIG. 10 to show a clamp drive;

FIG. 12 is a view like FIG. 11 showing the drive in a shifted and clamp actuating position;

FIG. 13 is an enlarged fragmentary elevation showing details of the clamping mechanism in actuated condition;

FIG. 14 is a view like FIG. 13 but showing the clamping mechanism released and hammer operation during printing;

FIG. 15 is a plan view on lines 15—15 of FIG. 14;

FIG. 16 is a plan view on lines 16—16 of FIG. 13, showing ribbon advance mechanism details;

FIG. 17 is a view of a portion of FIG. 16 showing the mechanism in actuated condition;

FIG. 18 is an enlarged fragmentary elevation on lines 18—18 of FIG. 16;

FIG. 19 is a plan view of a ribbon carrier or cartridge;

FIG. 20 is a side elevation on lines 20—20 of FIG. 19;

FIG. 21 is a fragmentary section on lines 21—21 of FIG. 20;

FIG. 22 is a fragmentary developed view of the printer drum;

FIG. 23 is a hammer strike sequence chart related to a particular set of thirteen type font segments;

FIG. 24 is an array illustrating alphanumeric characters and other symbols which can be print-generated using the type font on the drum; and FIG. 25 is a hammer strike sequence chart related to a particular set of sixteen type font segments.

DETAILED DESCRIPTION

General Organization

Referring first to FIGS. 1, 2, 10 and 13 the impact printer apparatus 10 basically comprises a first assembly 11 including a rotary print drum 12; a second assembly 13 including hammer means 14, an inked or transfer ribbon 15 and ribbon carrier 16; and support means supporting the two assemblies in longitudinally spaced relation so as to provide an upright slot 17 to receive a print sheet (such as an invoice 18 for example) between the drum at one side of the slot and local ribbon extent 15*a* and the hammer means 14 at the opposite side of the slot. In this regard, the hammer means may typically include a transverse row of hammers 14*a* seen in FIG. 1, a transverse pivot shaft for the hammer being indicated at 19 in FIG. 10. As there shown, flat springs 20 engage hammer arms 21 to urge the hammers counterclockwise away from the slot 17, whereas solenoid driven plungers 22 are operable to selectively drive the hammers clockwise toward the slot 17 to cause the ribbon extent 15*a* to impact any print sheet or media therein.

The two assemblies 11 and 13 are generally longitudinally spaced apart, and the slot 17 may advantageously extend transversely between the assemblies and be transversely open ended, whereby any width sheet or sheets may simply be inserted downwardly or endwise into the slot and positioned for printing. A stop or ledge 23 is carried by the support means to limit downward insertion of positioning of the print sheet 18, as for example is shown in FIG. 13. A detector 23*a* on boss 23*b* detects the presence of sheet 18.

Figure 1:
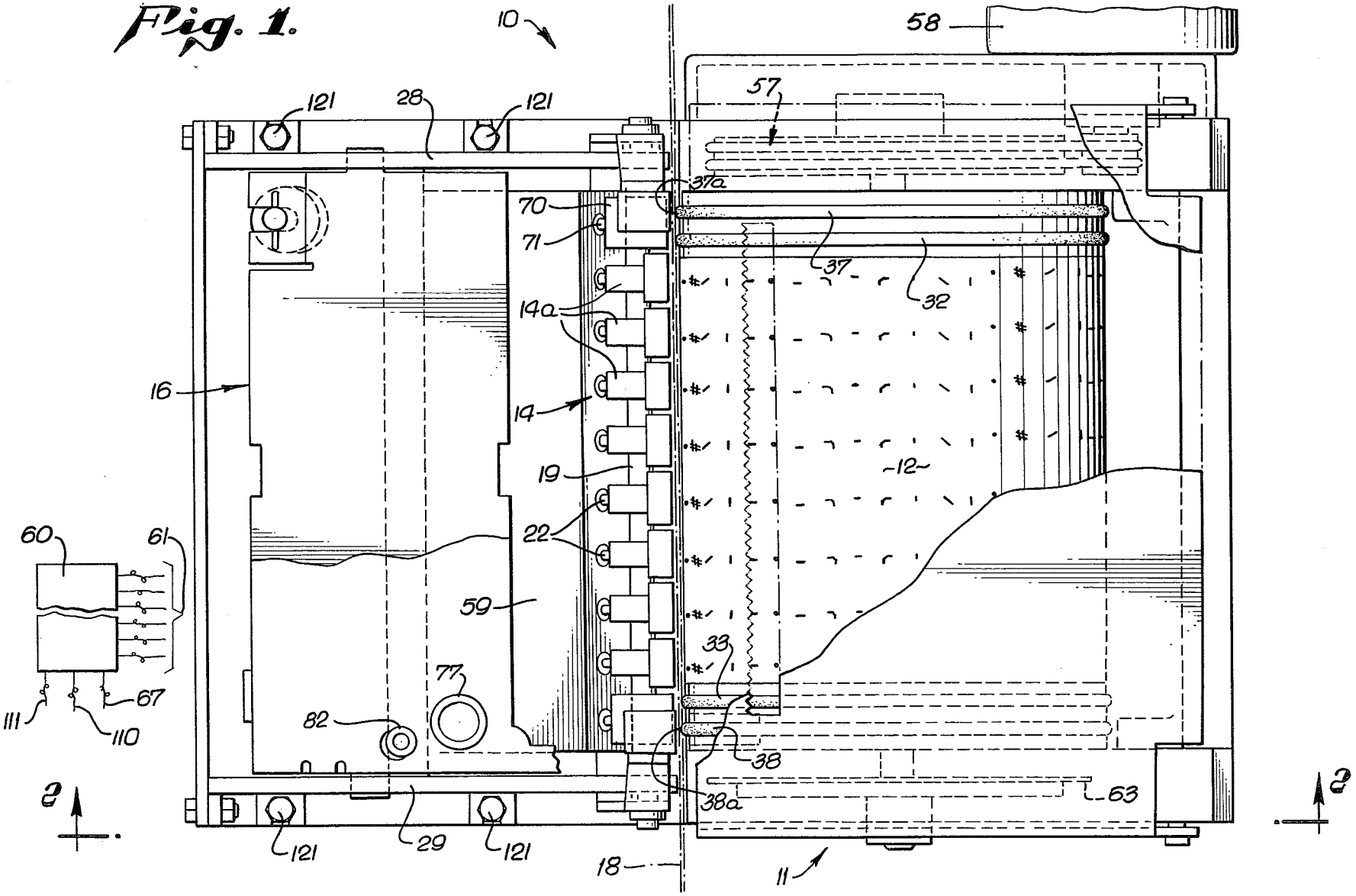
FIG. 1 is a plan view of printer apparatus incorporating the invention.

The support means for the two assemblies may include a base plate 24 extending longitudinally and laterally as shown beneath the assemblies. Also, the support means may include laterally spaced, longitudinally extending upright plate members 25 and 26 associated with assembly 11 and forming hubs 25*a* and 26*a* seen in FIG. 6 as defining a transverse axis 27 about which the drum 12 is rotatable. Further, the support means may include laterally spaced, longitudinally extending upright plate members 28 and 29 associated with assembly 13 and carrying the hammer means 14 and ink ribbon carrier 16, as seen in FIG. 1.

Print Sheet Advance

Figures 6, 7, 8, 9:
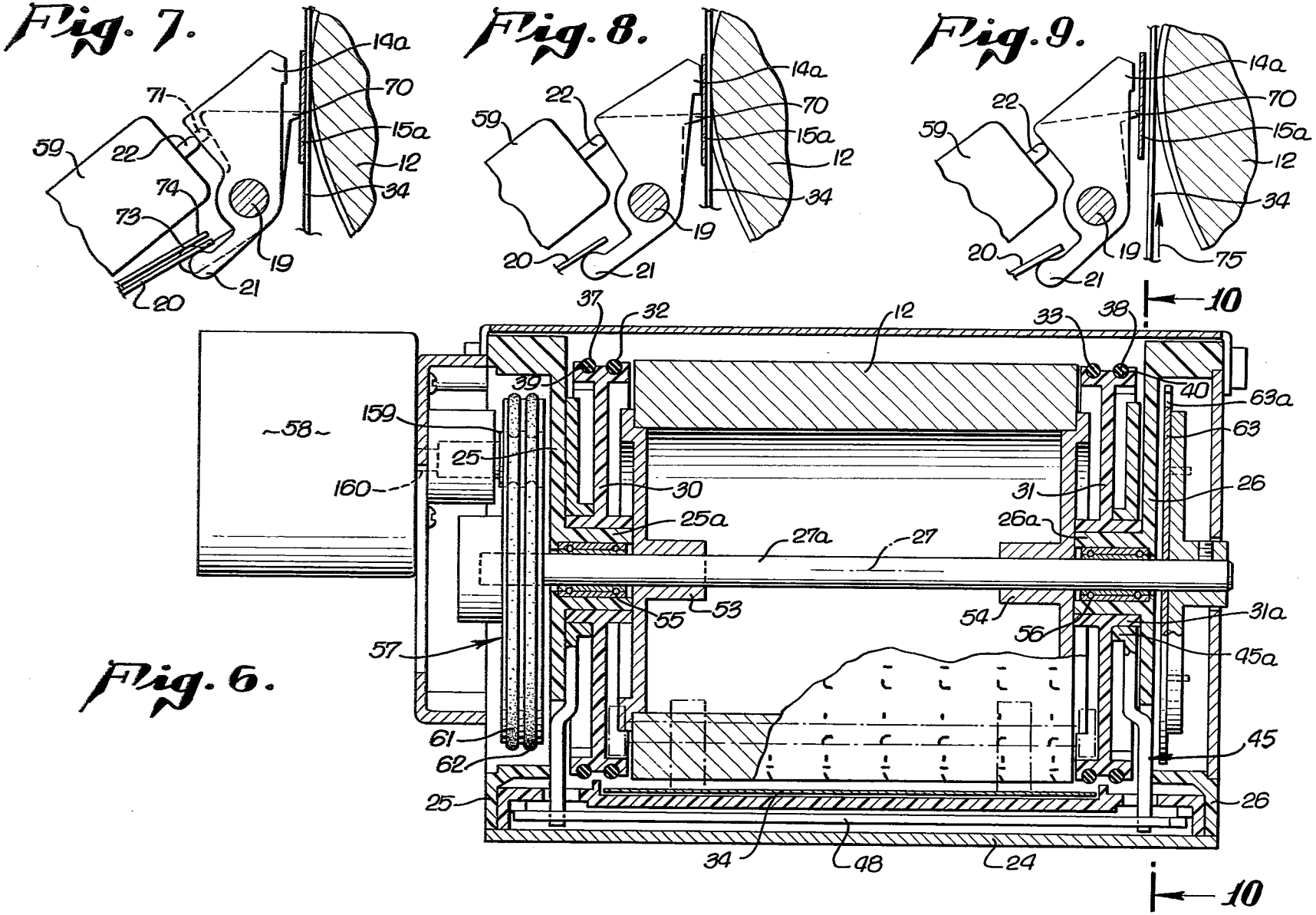
FIG. 6 is a vertical section on lines 6—6 of FIG. 2.
FIGS. 7, 8 and 9 are enlarged fragmentary views showing sheet clamping, printing and advance modes.

Referring again to first assembly 11, print sheet advancing means is provided to advance an endwise feedable print sheet beneath the drum and then upwardly in slot 17. The advancing means may with unusual advantage include a pair of rotors 30 and 31 respectively mounted on the hubs 25*a* and 26*a* (as seen in FIG. 6) for rotation about axis 27, the rotors typically including peripheral elastomeric O-rings 32 and 33 also extending about axis 27 for frictional driving engagement with the endwise feedable print sheet or journal paper 34, as seen in FIG. 10 and 10*a*. In this regard, note the pinch roller 35 in those views projecting through an opening 36 in an arcuate guide 36*a* for the paper 34 to urge the paper against O-ring 33 in the region of paper upward advancement just prior to entry into slot 17; i.e. the pinch roller engages the paper 34 outside, but proximate, the slot.

The rotors also include other peripheral friction loops 37 and 38 extending about axis 27 for frictional engagement with a print sheet such as the invoice 18 placed in the slot 17. Loops 37 and 38 may also comprise elastomeric O-rings, received in grooves 39 and 40 in the rotors 30 and 31. Rollers 41 associated with assembly 11 entrain at least one and preferably both loops 37 and 38 for guiding them to pass in straight vertical paths adjacent the slot, as at 37*a* and 38*a* in order to engage and frictionally advance the print sheet, i.e. upwardly in FIG. 13. For that purpose, a clamp in the form of a pinch roller 140 on arm 141 is swingable about pivot 42 to urge the invoice 18 against the loop stretch 38*a*. A drive to rotate arm 141 clockwise includes solenoid 142 and plunger 43 connected with the lower extent 141*a* of arm 141, as seen in FIGS. 10 and 13. A similar arm and pinch roller may cooperate with a loop stretch 37*a*.

The print sheet advancing means also includes rotor drive means operable to rotatably index the rotors 30 and 31, for correspondingly advancing the print sheets (either 18 or 34) as referred to. Such drive means includes ratchet means associated with one or both rotors, the ratchet means as shown in FIG. 10 including a circular series of ratchet teeth 44 on the rotor 31. The drive also includes ratchet arms 45 having a central portion 45*a* pivoted about the hub 31*a* define by rotor 31, a cantilevered arm extension 45*b* having rotatably reciprocating ratchet engagement with the individual teeth, one-by-one, as the drive proceeds clockwise in FIG. 10; i.e. the arm drives the tooth it engages (and therefore the rotor) in clockwise direction through a predetermined arc, and then the arm reciprocates in a counterclockwise direction to "ratchet" or ride over the inner tip of a tooth so as to engage the next tooth. The arm resiliently deflects inwardly in this process, and returns the arm tip 45*c* outwardly into the next notch formed between adjacent teeth. A second ratchet arm 100 for each rotor is carried by a fixed side plate member and projects into engagement with the sides of the teeth 44 to block reverse rotation of the rotor; however, arm 100 rides over the teeth during clockwise advancement of the rotor. This mechanism assures that the print sheet advancing means is blocked to prevent advancement of a print sheet during printing. Control 60 controls solenoid 142 for this purpose.

The drive means also includes a motor such as solenoid 46 operatively connected with the arm extension 45*d* to rotatably reciprocate same. FIGS. 11 and 12 show the solenoid opposite end plungers 46*a* and 46*b* connected via bell cranks 47*a* and 47*b* with a slide plate 48 to linearly reciprocate same in directions indicated by arrows 49 and 50. The plate is operatively connected with two such arms 45*d* (one for each rotor), as via notches 48*a* and 48*b* in the plate through which the arms extend to provide lost motion couplings. The solenoid and linkage members 46, 47 and 48 are located below arcuate guide 37, whereas the drum is located above the guide, i.e. at the concave side of guide surface 37*a* which guides the journal sheet or paper 34 toward the slot. As that paper rises in the slot (following printing) it is deflected rightwardly in FIG. 10, as by tang 150, and passes upwardly through an opening 51 in the housing top 52.

Type Font Drum and Hammers

As shown in FIG. 6, the drum 12 is mounted at 53 and 54 on the shaft 27*a*, the latter being journaled at 55 and 56 in the hubs 25*a* and 26*a* for high speed rotation, thereby rotating the drum. A sheave 57 on the shaft is driven by a motor 58 as via a pulley 159 on the motor shaft 160 and O-rings 61 and 62 entrained on the sheave and pulley. The drum typically carries at its surface type font means including multiple columns of type segments, the columns extending in arcs about the drum axis and spaced lengthwise thereof, as described in U.S. patent application Ser. No. 572,067 filed Apr. 28, 1975 by John D. Pylant et al. Successive arc shaped columns about the drum axis may be relatively shifted along that axis in accordance with the description in U.S. Pat. No. 3,850,097.

The second assembly 13 typically includes the above described hammer means 14 incorporating the multiple hammers 14*a* which are carried for movement toward and away from the drum and type font means thereon, during drum rotation. In this regard, the hammer pivot shaft 19 may have its opposite ends carried by the side plates 28 and 29. The hammers are selectively displaced by the actuators or plungers 22 toward selected type segments on the drum momentarily presented in alignment with the hammers. The solenoids 59 operate the plungers 22, and they may be connected with control means 60 as via electrical connections 61 seen in FIG. 1 and described in the above referenced U.S. patent application Ser. No. 572,067, and also in U.S. Pat. No. 3,850,097. Such control means selectively energizes the solenoids so as to cause the hammers to effect printing of selected type font impressions on the advancing print sheet, the operation being carried out in an on-the-fly basis. See FIGS. 1 and 10 in this regard.

Figures 2, 3, 4, 5:
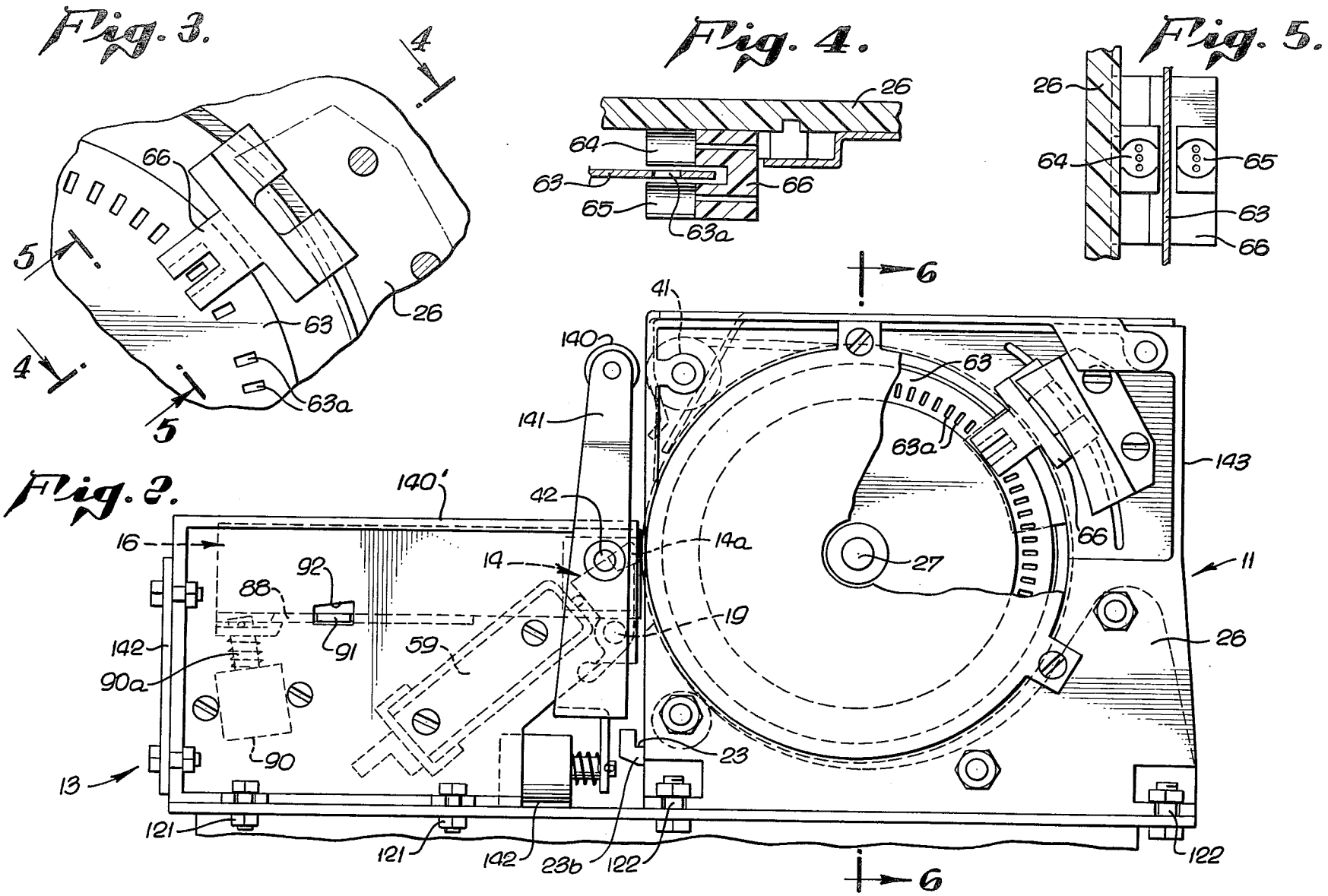
FIG. 2 is a side elevation on lines 2—2 of FIG. 1.
FIG. 3 is an enlarged fragmentary view of a portion of FIG. 2.
FIG. 4 is a section on lines 4—4 of FIG. 3.
FIG. 5 is a section on lines 5—5 of FIG. 3.

For that purpose, the drum 12 typically carries or is connected to a code wheel or timing disc 63 seen in FIGS. 1, 2 and 6. The disc contains timing slots 63*a* which are subject to counting or scanning as the wheel turns with the drum, so that the angular positions of the drum and type font thereon in relation to the hammers are accurately tracked at all times. Note the electric eye elements 64 and 65 scanning the disc slots in FIGS. 3–5. Such elements may be carried by first assembly side plate member 26, as via bracket 66, and they may be electrically connected to control 60, as via line 67.

Referring to FIGS. 1 and 7–9, clamps 70 are shown as also pivoted on hammer shaft 19 to be actuable by solenoid plungers 71. Such clamps are momentarily operated to clamp the print sheet, as for example sheet 34, against the arrested O-rings 32, 33, 37 and 38 just prior to the time when hammer 14*a* strikes the ribbon to effect printing. This is shown in FIGS. 7 and 8. Following such printing, the clamps 70 are retracted as shown in FIG. 9, retraction being effected as by deactivation of the solenoids that operate plungers 71, and by pressure exertion on the clamp arm 73 corresponding to the hammer arm, as by flat spring 74. Upward advancement of the print sheet is shown in FIG. 9 by arrow 75. The modified clamp 76 shown in FIGS. 14 and 15 is pivoted about an alternate shaft 77, as by actuator 78 which may be solenoid driven.

Ink Ribbon and Carrier

Referring to FIGS. 13 and 19–21, the print transfer medium, i.e. ink ribbon 15, is typically advanced by means engaging the ribbon to effect its endwise transport off the carrier 16 at 15*b*, advancement at 15*a* between the hammer and drum, and return to the carrier at 15*c*. The carrier or magazine 16 includes bottom, side, end and top walls 71–75, and defines an interior chamber 76 in which the typically endless ribbon is stored in serpentine folds at 15*d*. A ribbon drive rotor 77 is rotatable clockwise in FIG. 19 to advance the ribbon into one end of chamber 76, ribbon being drawn from the opposite end of that chamber through outlet 78. The ribbon inlet to the chamber appears at 79. A flat spring 80 bears against the ribbon leaving outlet 78 to provide tension keeping the ribbon extent 15*a* taut. An indicator disc 81 on top of the magazine is coupled to the drive rotor or roller 77 to rotate therewith and indicate that the drive is operating properly. An idler roller 82 in the magazine is urged by spring 83 against ribbon on roller 77, as best seen in FIG. 21, to cause the ribbon to advance with and turn about roller 77, for development of the initial folds 15*d* in chamber 76.

The cartridge includes resiliently deflectible latches 84 and 85 that project downwardly for connection onto edges 86 and 87 of a shelf or plate 88, as seen in FIG. 13. Shelf 88 suspends the mechanism to drive a ratchet wheel 89 integral with roller 77 and projecting below bottom wall 71 and through shelf 88. Also, shelf 88 is tiltable by solenoid 90 between two positions in one of which upper ribbon extent 15*a'* is in alignment with the hammers, and in the other of which lower ribbon extent 15*a''* is presented in alignment with the hammers. Accordingly, two different ribbon portions are selectively usable, and may have different ink colors, if desired. Ears 91 on shelf 88 project laterally oppositely through trapezoidal openings 92 in the frame members 72 and 73, and shown in FIGS. 2 and 13, to limit rocking of the plate by engagement with the upper and lower edges of such openings. The solenoid plunger 90*a* is pivotally connected to plate 88 at 120.

Referring to FIGS. 13 and 16–18, the ribbon advancing means includes mechanism including a driver such as solenoid 96 and a pawl 97 engageable with the ratchet wheel 89 to rotate same in response to stroking of the solenoid. For this purpose, the mechanism may include a crank arm 99 pivoted about the axis 100 of the wheel 89 below the shelf 91 to swing about that axis. The crank arm has lost motion connection at 101 to the solenoid plunger 96*a* and pivotally supports the pawl 97 at 102, there being a tension spring 103 urging the pawl counterclockwise in FIG. 16 toward the ratchet wheel teeth. As the plunger extends to FIG. 17 position, the pawl ratchets over the wheel teeth, and on the return stroke of the plunger the pawl rotates the wheel 89 to index or advance the ribbon. A flat spring finger 104 blocks reverse rotation of the wheel, and ratchets over the teeth as the wheel turns. A stop 106 on plate 88 limits the extension stroke of the plunger 96*a*.

The control 60 initiates indexing operation of the solenoid 96, as via lead 110; and control 60 also operates the solenoid 90, as via lead 111 when desired by the operator.

It will be noted that the first and second assembly side plates may be bolted to the base plate 24, as for example is illustrated by bolts 121 connecting side plate 29 to the base plate in FIG. 2, and bolts 122 connecting side plate 26 to the base plate. Accordingly, it is very simple to extend the transverse length of the printer, i.e. adapt to larger printer sizes, as by extending plates 26 and 29 further from plates 25 and 28 and substituting more hammers, a longer drum, and a transversely elongated ribbon cartridge.

Another top plate 140' is shown, in FIG. 2, and end plates at 142 and 143.

If desired, the slot 17 may be extended downwardly through the base plate 24 to accommodate print sheets of any vertical length. Such a slot continuation is shown by broken lines 17*a* in FIG. 13. The base plate 24 may be of any width or configuration required to accommodate slot extension 17*a;* as the two assemblies may be connected via their side plates.

The drum typically carries at its surface type font means including multiple columns of type segments outstanding from the drum surface, the columns extending in arcs about the drum axis and spaced lengthwise thereof. See for example the developed columns 200*a–200e* and 201*a–201b* in FIG. 22. Successive arc shaped columns about the drum axis, as for example columns 200*a* and 201*a*, are relatively shifted along the shaft axis in accordance with the description in U.S. Pat. No. 3,850,097. There are thirteen segments of type in each column shown in FIG. 22, the segments of each column being the same as corresponding segments in the other columns, and capable of selective combination to form all alphanumeric characters (the numbers 1–9, 0, and the letters A–Z). Also, additional symbols may be formed as shown in the FIG. 24 array which depicts the symbols and alphanumeric characters in enlarged form.

FIG. 23 depicts, for each character or symbol to be reproduced or printed (in the vertical column to the left of the X mark "strike" zone), a combination of type font segments necessary to be "struck" by a hammer, and the strike sequence. Such segments extend in a row at the top of the chart and are the same as appear in columns in FIG. 22. Below each segment are two columns, the successive columns numbered in sequence. The first column of each pair indicates a relatively early strike and the second of each pair indicates a later or late strike (in time).

Referring to letter A in the FIG. 24 array, it is assembled or printed by hammer strikes indicated by X's to the right of the A character in FIG. 23, and found in columns numbers 7, 12, 13, 16, 17 and 24. These numbers also are labeled on the A in FIG. 24, and similar numbers appear on the other characters and symbols in FIG. 24 to show the make-up of the hammer strikes, as the drum rotates. Such type font segments enable the print-out of a maximum number of most useful symbols and alphanumeric characters for a given symbol size and drum size.

A typical printer will employ hammers each of which spans 3 or 4 columns; however more than 4 columns may be spanned by each hammer.

FIG. 25 illustrates a somewhat modified table showing a row of 16 (instead of 13) type font segments which may alternately be employed on the drum. These segments have the same advantages as those in the FIG. 23 table; in addition, the FIG. 25 sequence of type font segments, when used in an arc shaped column on the drum, enables printing of a full character or symbol during each revolution of the drum, the full print-out occurring during one pass of the arc shaped column past the hammer.

We claim:

1. In impact printer apparatus operable to rapidly print characters on a print sheet in lines and columns, and including:

a first assembly including a continuously rotating rotary print drum having an axis of rotation, a second assembly including hammer means, a print transfer medium and carrier therefor, the improvement comprising:

support means supporting said assemblies in spaced relation to provide a print sheet receiving slot between the drum at one side of the slot and local extent of said transfer medium and hammer means at the opposite side of the slot, said assemblies being generally spaced transverse to said axis or rotation, and said slot extending between the assemblies parallel to said axis of rotation and being open-ended, print sheet advancing means associated with said first assembly to advance an endwise feedable print sheet endwise beneath the drum and then upwardly in the slot, the support means including first and second side plates at opposite sides of the slot, the drum located between the first side plates, said print sheet advancing means including a pair of rotors rotatable about said drum axis at opposite ends of the drum and between the first side plates, and rotor drive means including ratchet means operable to rotatably index said rotors, said ratchet means includes a circular series of ratchet teeth on at least one of the rotors, said teeth projecting inwardly toward the drum axis, at least one actuator arm having rotatably reciprocating ratchet engagement with said teeth, and said drive means includes a motor operatively connected with said arm to rotatably reciprocate the arm.

2. The combination of claim 1 wherein said teeth are on each of said rotors, there are two of said arms respectively engageable with the teeth on the rotors, there being an arcuate guide for said endwise feedable sheet, the drum being at the concave side of said guide, and said motor being at the opposite side of said guide, said rotor drive means including linkage means connecting the motor with each of said arms.

3. The combination of claim 1 wherein said rotors include certain peripheral friction rings extending about said axis for frictional engagement with the sheet in proximity to the drum, but outside the slot, to advance the endwise feedable print sheet.

4. The combination of claim 3 wherein said rotors include other peripheral friction loops extending about said axis for frictional engagement with a print sheet placed in said slot.

5. The combination of claim 3 including a certain pinch roller for urging the endwise feedable print sheet against one of said certain rings in proximity to the drum but outside the slot.

6. The combination of claim 5 including another roller entraining one of said other peripheral loops for guiding said other loop to pass in a straight adjacent said slot in order to engage and frictionally advance said print sheet, and a clamp carried to urge the print sheet against said straight stretch.

* * * * *

UNITED STATES PATENT OFFICE

CERTIFICATE OF CORRECTION

PATENT NO. : 4,092,921

DATED : June 6, 1978

INVENTOR(S) : Andrew M. McInnis et al

It is certified that error appears in the above-identified patent and that said Letters Patent are hereby corrected as shown below:

At Column 8, line 3, "or" (last word on line) should be --of--.

At Column 8, line 48, after "straight" insert --stretch--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*